United States Patent [19]

Jaworski

[11] Patent Number: 4,641,821

[45] Date of Patent: Feb. 10, 1987

[54] WORKPIECE HOLDER

[76] Inventor: Henry J. Jaworski, 6374 Mettetal, Detroit, Mich. 48228

[21] Appl. No.: 716,490

[22] Filed: Mar. 27, 1985

[51] Int. Cl.[4] ..... B25B 1/08

[52] U.S. Cl. ..... 269/234; 269/157; 269/303

[58] Field of Search ..... 269/13, 14, 122, 157, 269/217, 234, 303, 317, 134, 136, 138

[56] References Cited

U.S. PATENT DOCUMENTS

| | | | |
|---|---|---|---|
| 1,946,426 | 2/1934 | Kennedy | 269/157 |
| 2,625,861 | 1/1953 | Swanson | 269/234 |
| 3,100,413 | 8/1963 | Varga | 83/180 |
| 3,758,099 | 9/1973 | Scott | 269/38 |
| 4,128,235 | 12/1978 | Gersbacher | 269/234 |
| 4,175,737 | 11/1979 | Foss | 269/317 |

*Primary Examiner*—Roscoe V. Parker

*Assistant Examiner*—Judy J. Hartman

*Attorney, Agent, or Firm*—Gifford, Groh, VanOphem, Sheridan, Sprinkle and Dolgorukov

[57] ABSTRACT

A workpiece holder comprising a base having guide walls defining a workpiece pathway and a linear pushbar displaceably mounted to said base to extend laterally toward the pathway. The pushbar includes an upper wedge-shaped arm adapted to mate with a wedge-shaped member fixed in a substantially fixed position with respect to said base and a second locking arm adapted to engage the edge of a workpiece at the workpiece station. The upper arm of the pushbar extends over a locking plate resiliently supported above the base so that insertion of the wedge depresses the locking plate upon the workpiece. A work stop is displaceably mounted at an end of said pathway to align the workpiece at the workpiece station before it is clamped in place for a machining operation.

11 Claims, 4 Drawing Figures

Fig-1
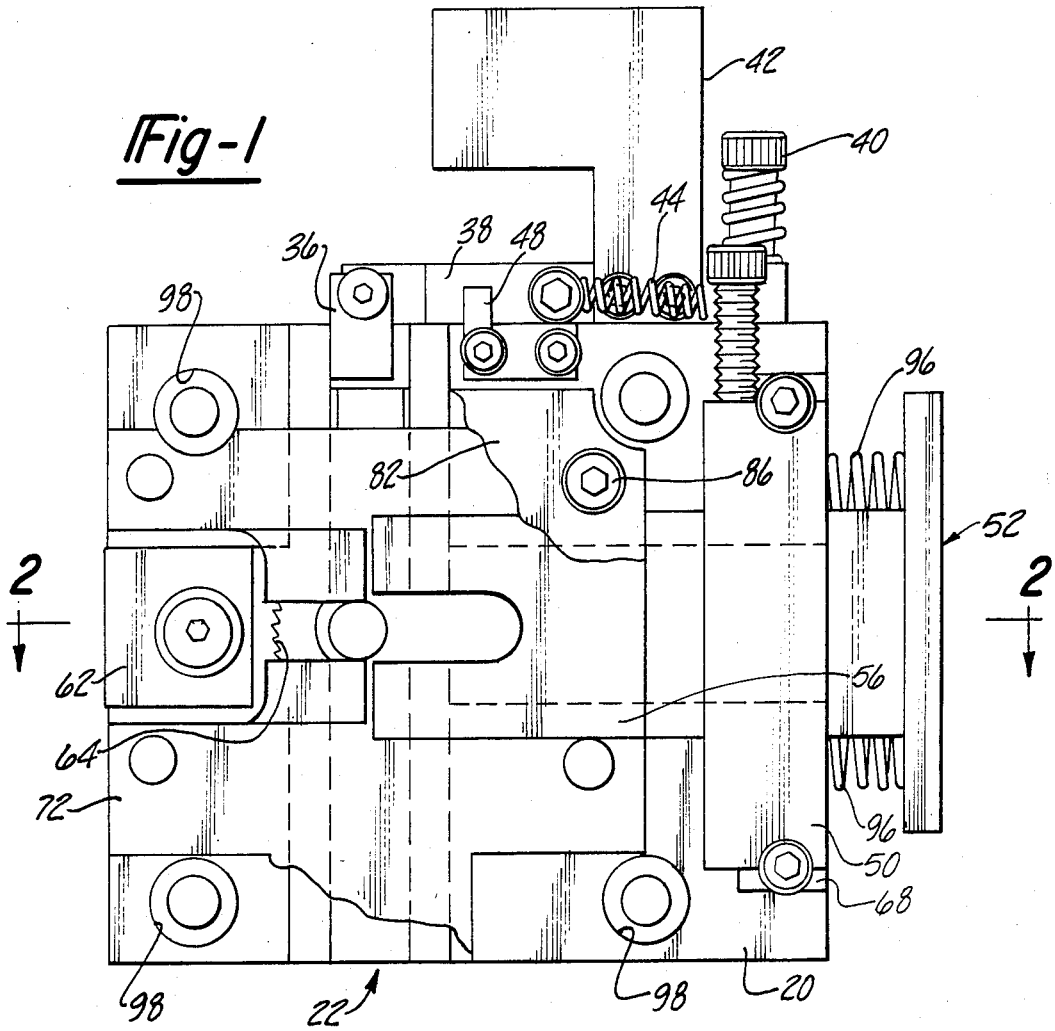
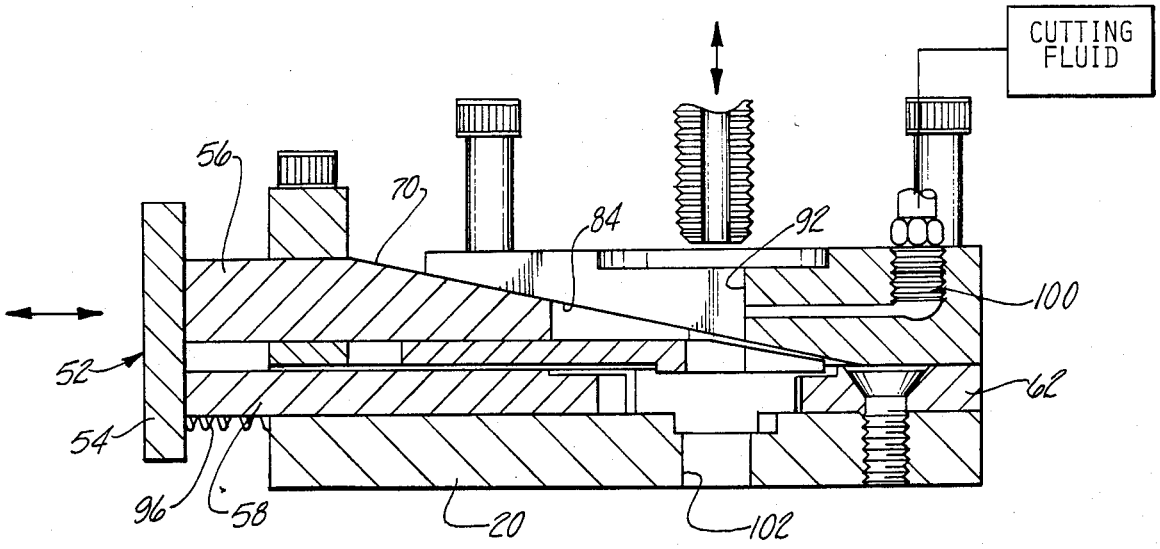
Fig-2

WORKPIECE HOLDER

BACKGROUND OF THE INVENTION

I. Field of the Present Invention

The present invention relates generally to workpiece holders, and more particularly to a workpiece holder having a linearly displaceable bar whose movement simultaneously locks the workpiece horizontally and vertically in a fixed position.

II. Description of the Prior Art

While there are many previously known workpiece clamps, most devices for clamping workpieces that have curved peripheral surfaces are often complex and complicated. In particular, since the curved surface can roll when engaged against flat guide walls, it can be extremely difficult to retain the workpiece in a fixed position for a machining operation. As a result, workpiece holders are often particularly shaped in the configuration of a workpiece so that the workpiece is stably supported in a fixed position for machining. Unfortunately, such particularly configured workpiece holders often require that each workpiece be individually positioned and removed from a workpiece holder and such workpiece holders are not well adapted for use in production line assembly. Although it has been known to mechanize the delivery and extraction apparatus, such apparatus can be extremely complex when the workpiece must be accurately positioned in the conforming cavity and substantially increases the cost of the production operation.

Another previously known workpiece holder for locking circular workpieces in a fixed position for machining comprises three or more radially aligned jaw members which are driven radially inwardly to engage the circular peripheral edge of a workpiece at three spaced circumferential points. However, the synchronization of movement of the arms along three different directions can be rather complex, especially when the arms must be retracted from a workpiece production line path. Moreover, each arm must be accurately aligned so as to properly position the workpiece at a workpiece station for accurate engagement by a machining tool.

SUMMARY OF THE PRESENT INVENTION

The present invention overcomes the above mentioned disadvantages by providing a workpiece holder having a simple pathway for production parts and means for locking a workpiece at a work station in the pathway by a single linearly displaceable member. The linear displacement of the member causes a simultaneous depression of a workpiece against the base and lateral engagement against the guide forming the pathway.

In general, the workpiece holder has a base forming a workpiece pathway, a mechanism for aligning a workpiece at predetermined workpiece station in the pathway, a pushbar and a mechanism for linearly displacing the pushbar with respect to the base. Linear displacement of the pushbar by a linear actuator such as a pneumatic cylinder causes a workpiece such as a weld nut to be depressed against the bottom of the pathway as well as engaged transversely against the guide which forms the pathway. As a result, the workpiece is stably supported and precisely positioned for engagement by a machine tool such as a tap at the workpiece station.

In the preferred embodiment, the pushbar includes a wedge adapted to be received between an upper plate having a correspondingly inclined surface and a lower locking plate so that insertion of the pushbar forces the locking plate down against the workpiece at the workpiece station. An additional arm on the bar peripherally engages the edge of the workpiece to force it against the guide forming the workpiece pathway. Although the plates are secured in a relatively fixed position, they are retained in their substantially fixed position by resilient biasing members to prevent damage to the components and the mating surfaces upon full insertion of the push bar during locking.

In addition, the preferred embodiment includes a mechanism for aligning the workpiece at the workpiece station in the pathway in the form of a pivoting lever positioned at a discrete distance downstream of the workpiece station. The lever is pivotally mounted to the base so that it can be moved between the first position at which it obstructs the pathway, and the second position in which lever is clear of the pathway. The discrete distance between the lever and the workpiece station is substantially equal to the length of the workpiece, or a multiple of that length, so that the workpiece is generally positioned at the workpiece station before engagement by the linearly actuated locking mechanism.

As a result, the present invention provides a workpiece holder adapted for use in the production line which does not require complicated or complex movements of a workpiece along the production line. Moreover, a single linear movement of a pushbar locks the workpiece in a fixed and stable position for engagement by a machining tool. Moreover, the holder is constructed to accommodate a repeated actuation of the pushbar without subjecting the holder to undue stress or forces which can substantially reduce the working life of the holder. These and other advantages will be discussed in greater detail in the detailed description provided hereinafter.

BRIEF DESCRIPTION OF THE DRAWING

The present invention will be more clearly understood by reference to the following detailed description of the preferred embodiment of the present invention when read in conjunction with the accompanying drawing, in which like reference characters refer to like parts throughout the views and in which:

FIG. 1 is a top plan view of a workpiece holder constructed in accordance with the present invention with portions broken away for the sake of clarity;

FIG. 2 is a sectional view taken substantially along the line 2—2 in FIG. 1;

DETAILED DESCRIPTION OF A PREFERRED EMBODIMENT OF THE PRESENT INVENTION

Figure 4:
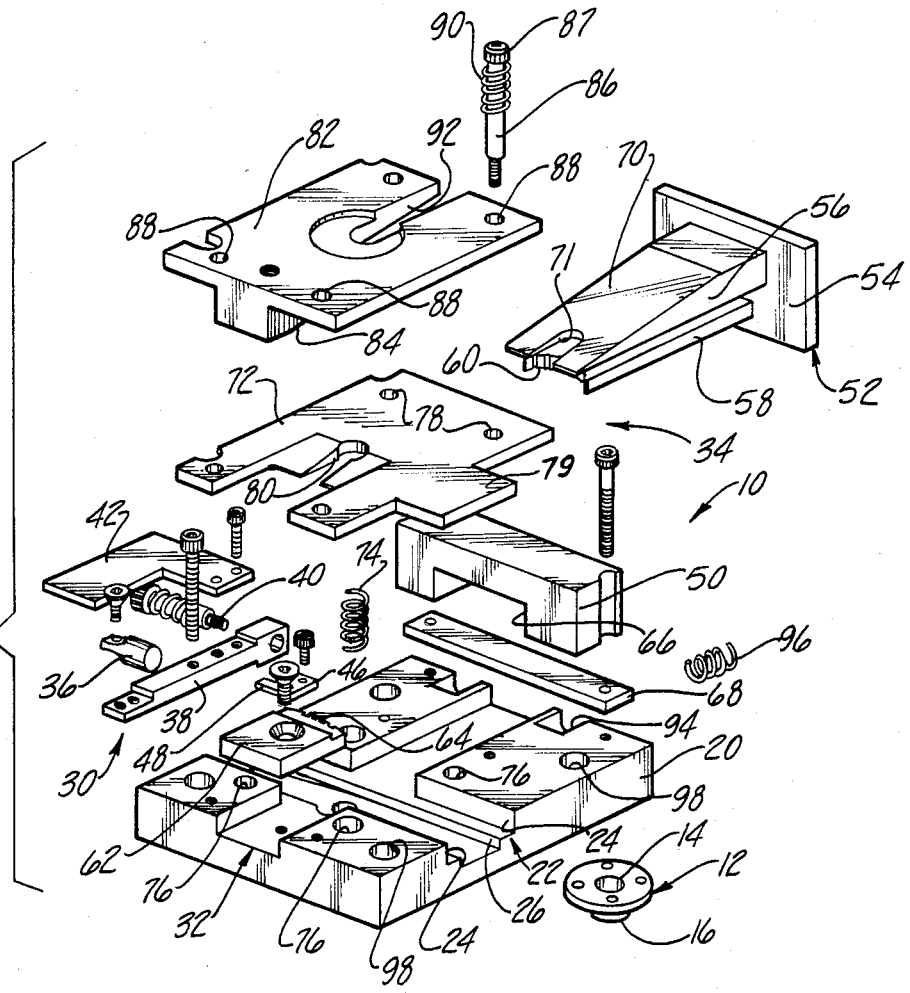
FIG. 4 is an exploded perspective view of the workpiece holder shown in FIGS. 1–3.

Referring first to FIG. 4, a workpiece holder 10 according to the present invention is thereshown for use in conducting a machining operation on a weld nut 12. The weld nut 12 includes a central aperture 14 which is to be tapped at the workpiece station provided by the holder 10. The complexity of the shape of the weld nut 12 is further compounded by the fact that it includes an elongated stem 16 and thus adds to the difficulty in stably supporting the workpiece for a machining operation. Nevertheless, while the holder 10 shown in the preferred embodiment is particularly adapted to receive the weld nuts 12, other workpieces having circular and irregularly shaped components can also be used with a workpiece holder constructed within the scope of the present invention.

The workpiece holder 10 comprises a base 20 defining a workpiece pathway 22. In the preferred embodiment, the pathway 22 is formed by a groove defined by peripheral guide walls 24 spaced apart so as to receive the weld nut 12, therebetween, and also including a trough 26 adapted to receive the stem 16. The weld nut 16 can be fed to the pathway 22 by a feeding device (not shown) so that weld nuts are sequentially arranged along the pathway. The pathway 22 forms or becomes a part of a production line for machining of the weld nuts 12.

The workpiece holder 10 also includes an alignment assembly 30 for aligning the weld nuts 12 at a workpiece station indicated generally by the transverse groove 32 in the base 20 where it intersects the workpiece path 22. The alignment assembly 30 serves to position the weld nut 12 for engagement by a locking mechanism 34 for simultaneously depressing the weld nut 12 against the bottom of the pathway 22 and laterally against the peripheral guide wall 24.

Figure 3:
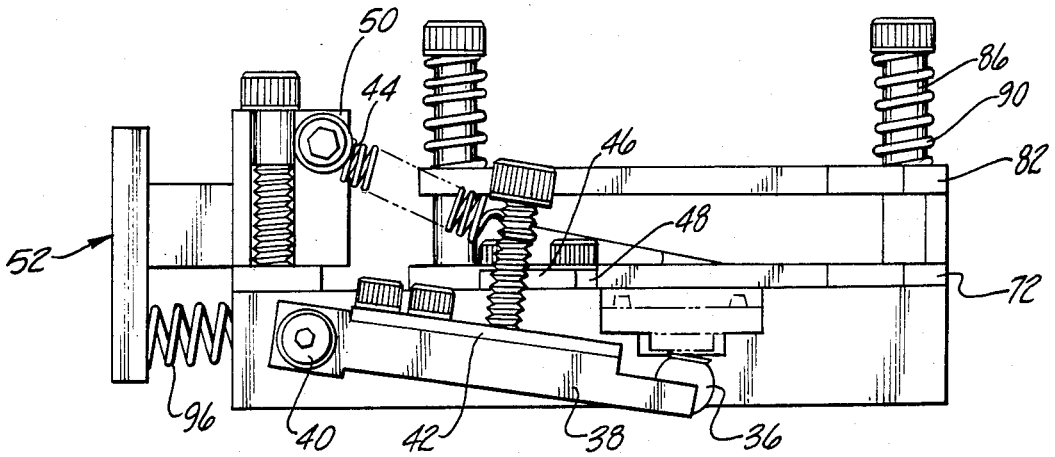
FIG. 3 is a side elevational view of the holder shown in FIGS. 1 and 2.

As is best shown in FIGS. 3 and 4 the alignment assembly 30 comprises a workstop 36 mounted at one end of a lever arm 38. The other end of the lever arm 38 pivots about a pivot pin 40 threadably secured in the edge of the base 20 so that the arcuate path of the workstop 36 crosses the workpiece pathway 22. An actuator arm 42 is mounted to lever arm 38 and forms an abutment surface for a linear drive mechanism such as a piston rod of a pneumatic cylinder. A spring 44, secured at one end to a holding bolt secured to a base stanchion 50 and at its other end to a holding bolt threadably engaged in the lever arm 38, urges the lever arm 38 upwardly against a lever arm stop 46 mounted to the base 20 and having projection 48 extending over the lever arm 38.

With the lever arm 38 engaged against the projection 48, the workstop 36 is positioned in the pathway 22 and provides an abutment surface for the weld nuts 12 sliding along the pathway 22. Preferably, the distance between the edge of the workstop member 36 and the workpiece station generally indicated by the groove 32 in base 20 is the same length as the diameter of a weld nut 12, or a multiple thereof so that the workstop 36 and an adjacent weld nut 12 serves to position a weld nut 12 at the workpiece station as the weld nuts slide along the pathway 22. However, it will be understood that momentary depression of actuating arm 42 causes like movement of the lever arm 38, whereby the workstop 36 is positioned out of the workpiece pathway 22. As the workpieces are driven by gravity, a feeding device or the like, workpieces 12 are sequentially displaced along the workpiece pathway 22. Nevertheless, the workstop 36 automatically returns to its first position obstructing the pathway 22 when the actuating arm 42 is disengaged by the actuating device and thus positions a new workpiece 12 at the work station for a machining operation.

The locking mechanism 34 comprises a pushbar 52 having a base plate 54, an upper, wedge shaped arm 56 and a locking arm 58. The locking arm 58 rides in the channel 32 formed in the base so as to register with the edge of the weld nuts 12 passing through the workpiece pathway 22. The free end of the locking arm 58 includes a concave recess 60 conforming with the peripheral configuration of the weld nut 12 and can be provided with gripping teeth as shown in FIG. 4. A jaw plate 62 is secured in the groove 32 on the opposite side of a workpiece pathway 22 and includes a gripping surface 64 forming a portion of the guide wall 24 which faces the concave edge 60 of the locking arm 58.

The upper arm 56 is spaced above the locking arm 58 so as to be positioned above the weld nuts 12 passing through the workpiece pathway 22. The upper arm 56 is entrained within a channel 66 formed in the stanchion 50. A guide bar 68 is mounted beneath the sanchion 50 to extend between the upper arm 56 and the locking arm 58. The upper arm 56 includes an inclined surface 70, and the free end of the arm 56 preferably extends beyond the end of the locking arm 58 so as to extend over at least a portion of a weld nut 12 when it is engaged by the recessed end 60 of locking arm 58. As a result, the end of the arm 56 includes a recess 71 through which a machining tool can extend to engage a workpiece.

A locking plate 72 is positioned beneath the upper arm 56 and substantially adjacent to the guide bar 68 mounted on the base 20. However, the locking plate 72 is resiliently urged upwardly from the base 20 by a plurality of springs 74 (one shown in FIG. 4) engaged in spring sockets 76 formed in the base 20. Thus, the locking plate 72 is normally retained at a height which permits the weld nuts 12 to move freely beneath the locking plate. The locking plate 72 is retained in a substantially fixed position with respect to the base 20 by locking pins 86 secured in the base 20 and slidably engaged in apertures 78 in the locking plate 72. The lower surface of the locking plate 72 substantially covers the entire workpiece pathway 22 at the workstation except for a recess 80 which enables a machining tool to engage the weld nut 12 at the workstation. Furthermore, an extended lip 79 can extend over the pathway 22 adjacent the workpiece station to assure that the weld nuts 12 are properly aligned before reaching the workpiece station.

An upper plate 82 includes a wedge shaped lower member having a surface 84 inclined to mate with the inclined surface 70 of the upper arm 56 on pushbar 52. The upper plate 82 is retained in a substantially fixed position with respect to the base 20 by the pins 86 slidably received through holes 88 in the upper plate 82. Moreover, four tensioning springs 90 (one shown in FIG. 4) engaged between the head 87 of pins 86 and the upper surface of the upper plate 82 resiliently urge the upper plate 82 downwardly against the upper arm 56 of the pushbar 52. In the preferred embodiment, the springs 90 have a greater spring constant than the springs 74 so that insertion of the pushbar 52 causes the locking plate 72 to seat against the top surface of the base 20 before continued insertion of the pushbar 52 can urge the upper plate 82 to rise slightly. As a result, the locking mechanism 34 provides secure locking of the workpiece while avoiding undue wear or stress in the components.

The upper plate 82 also includes a recess 92 adapted to permit the machining tool to enter the workpiece holder and engage the workpiece at the workstation. Moreover, the upper plate 82 includes a lubrication passageway 100 (FIG. 2) for introducing cooling or lubricating fluid to the workpiece station. A plurality of ports extend through the peripheral wall defining the recess 92 for distribution of fluid at the work station.

The base 20 also includes recesses 94 under the guide bar 68 adapted to receive coil springs 96. The springs 96 extend outwardly toward the plate 54 of the pushbar 52 and resiliently urge the pushbar 52 to a retracted position, whereby the springs 74 in the sockets 76 normally urge the locking plate 72 upwardly so that the weld nuts 12 can move freely within the workpiece pathway 22. Conversely, a linear actuator acting against the pushbar 52 depresses the springs 96 when moving the pushbar 52 into the clamping position.

Having thus described the important structural features of the preferred embodiment of the present invention, the operation of the device is easily described. The base 20 can be mounted to a machining frame so that the workpiece pathway 22 registers with a conveyor, agitating feeder or other input device for providing a sequential supply of weld nuts 12 or other workpieces to the workpiece station. Countersunk bores 98 are formed on the base 20 for receiving mounting bolts to be used to secure base 20 in a fixed position with respect to a production line platform or other frame. As the weld nuts 12 enter the workpiece pathway 22 formed in the base 20, they can be freely moved within the guide walls 24 and beneath the locking plate 72. Preferably, the base 20 is mounted at a slight incline so that gravity can be used to force the weld nuts along the pathway toward the workstop 36.

When the pathway 22 is filled with weld nuts, it will be understood that the weld nut 12 abutting against the stop member 36 positions the adjacent weld nut substantially at the workstation corresponding with the groove 32 in the base 20. The pushbar 52 is then driven inwardly by a linear drive means such as a piston of a pneumatic cylinder. As a result, the inclined surface 70 of the pushbar 52 mating with the inclined surface 84 of the upper plate 82 thereby drives the locking plate 72 downwardly against the pressure of the springs 74 and urges the locking plate 72 into tight engagement with the top surface of the weld nuts 12. Further insertion of the pushbar 52 increases the force with which the weld nut is depressed against the workpiece pathway 22 until the recessed end 60 of the lower locking arm 58 engages the peripheral edge of the weld nut 12 and locks it against the surface 64 of the jaw plate 62. As a result, the weld nut is tightly and stably engaged within the workpiece holder in proper alignment for a machining operation. The recesses 92, 71 and 80 permit a machining tool to engage the weld nut 12 at the work station for a machining operation such as threadably tapping the central hole 14. When the linear actuating means is disengaged from the pushbar 52, the pushbar returns to an extracted position whereby the locking arm 58 no longer engages the weld nut and the locking plate 72 rises due to the force of the spring 74 urging it upwardly. As a result, the weld nuts are again freely movable along the workpiece path.

Once the machining operation has been completed, another actuating device, such as a piston of a pneumatic cylinder aligned for engagement with the actuator arm 42, can be used to momentarily pivot the lever arm 38 so that the workstop 36 no longer obstructs the free flow of workpieces along the workpiece path 22. As a result, the weld nut 12 which was held against the workstop can be discharged to a collection bin or other further production line. As a result, the weld nut previously tapped is then used to align an adjacent weld nut at the workpiece station.

As a result, the present invention provides a workpiece holder which quickly and effectively clamps workpieces in a fixed position for a machining operation. Moreover, workpiece holder requires only a single linear actuator in order to clamp the workpieces passing through the device. Nevertheless, the single linear movement used to clamp the workpiece in a workpiece station seats the workpiece against bottom of the pathway as well as locking it across the pathway in a fixed position for a machining operation.

Having thus described the present invention, many modifications thereto will become apparent to those skilled in the art to which it pertains without departing from the scope and spirit of the present invention as defined in the appended claims.

What is claimed is:

1. A workpiece holder for fixedly retaining a workpiece comprising:

a base having a groove defining a workpiece pathway, a portion of said groove defining a workpiece station, said workpiece station having a bottom surface and at least one side surface;

a locking plate movably mounted to said base, said locking plate disposed above said workpiece station;

means for mounting said locking plate to said base biasing said locking plate in a direction away from said base;

an upper plate mounted to said base, said upper plate having a portion positioned a predetermined space apart distance above said locking plate;

a pushbar slidably mounted to said base, said pushbar mounted to slide between a predetermined retracted position and a predetermined locked position; said pushbar having a wedge portion integral with and spaced apart from a locking arm said locking arm having an end portion positioned to direct said workpiece into abutment with said side surface of said workpiece station to hold said workpiece at the workpiece station when said pushbar is in the locked position, said wedge portion interposed said upper plate and said locking plate, said wedge portion directing said locking plate against said workpiece to hold said workpiece between said bottom surface of said workpiece station and said locking plate when said pushbar is in the locked position; whereby the workpiece is held in both a vertical direction and a horizontal direction by a single movement of the push bar into said locked position.

2. The workpiece holder as defined in claim 1 and further comprising means for aligning said workpiece at said workpiece station, said means for aligning comprising a workstop and means for displacing said workstop to and from a first position in which said workstop obstructs said pathway and a second position in which said workstop is spaced apart from said pathway.

3. The workpiece holder as defined in claim 2 and further comprising means for resiliently urging said work stop toward said first position.

4. The workpiece holder as defined in claim 1 wherein said means for sliding further comprises means for laterally displacing said pushbar along a plane normal to said pathway.

5. The workpiece holder as defined in claim 1 and further comprising means for supporting said locking plate over said pathway and beneath said upper plate, so that said locking plate is vertically displaceable and means for resiliently urging said locking plate to a position spaced apart from said base.

6. The workpiece holder as defined in claim 1 wherein said wedge portion comprises at least one inclined surface and wherein one of said upper plate and said locking plate comprises a correspondingly inclined mating surface.

7. The workpiece holder as defined in claim 1 and further comprising means for supporting said upper plate housing means for vertically, slidably supporting said upper plate in a substantially fixed position over said wedge portion and means for resiliently urging said upper plate downwardly toward said substantially fixed position.

8. The workpiece holder as defined in claim 7 wherein said means for resiliently urging said locking plate comprises at least one first spring and wherein said means for resiliently urging said upper plate comprises at least one second spring.

9. The workpiece holder as defined in claim 8 wherein each said second spring has a spring constant greater than the spring constant of each said first spring whereby said locking plate is forced downwardly before said upper plate moves upwardly when said wedge portion is inserted therebetween.

10. The invention as defined in claim 2 wherein said means for aligning comprises a workstop, means for pivotally securing said workstop for movement between a first position in which said workstop extends into said pathway and a second position in which said workstop is retracted away from said pathway, and means for resiliently biasing said workstop toward said first position.

11. The workpiece holder as claimed in claim 1 wherein said end of said locking arm has a portion adapted to grippingly receive a portion of said workpiece.

* * * * *